United States Patent [19]

Hsu

[11] 4,300,695

[45] Nov. 17, 1981

[54] FOLDING CONTAINER

[76] Inventor: Te-Chi Hsu, 3 Fl., 496-2, Fuchin St., Taipei, Taiwan

[21] Appl. No.: 99,213

[22] Filed: Nov. 30, 1979

[51] Int. Cl.[3] ..... B65D 7/24

[52] U.S. Cl. ..... 220/6; 220/4 F; 220/7

[58] Field of Search ..... 220/4 F, 6, 7

[56] References Cited

U.S. PATENT DOCUMENTS

| | | | |
|---|---|---|---|
| 3,628,683 | 12/1971 | Frederick | 220/6 |
| 3,809,278 | 5/1974 | Csmrik | 220/4 F |
| 3,955,703 | 5/1976 | Zebarth | 220/6 |
| 4,057,165 | 8/1977 | Kardell | 220/6 |
| 4,181,236 | 1/1980 | Prodel | 220/4 F |

FOREIGN PATENT DOCUMENTS

| | | | |
|---|---|---|---|
| 2520043 | 11/1976 | Fed. Rep. of Germany | 220/4 F |
| 1337862 | 8/1963 | France | 220/4 F |
| 554255 | 6/1957 | Italy | 220/4 F |
| 611899 | 10/1960 | Italy | 220/4 F |

*Primary Examiner*—George E. Lowrance

*Attorney, Agent, or Firm*—Browdy and Neimark

[57] ABSTRACT

A collapsible container molded from plastic materials, comprising four side walls, a bottom, and a lid. Side walls are hinged to the bottom to fold inwardly. The hinges are designed to facilitate mold-removing after injection molding. Groove ribs and strip ribs are provided to hold the structure rigid. Eave device is provided on the hinges to make the container weatherproof.

8 Claims, 6 Drawing Figures

FOLDING CONTAINER

BACKGROUND OF THE INVENTION

1. Field of the Invention

The present invention relates to a new and improved folding container having light weight, rigid structure and easy to be manufactured.

2. Description of the Prior Art

Most containers, especially large types, require a large amount of storage space when not in use, and take a lot of trouble to be carried and transported. Many different structures have been devised to allow such containers to be collapsed for storage. A widely used one is attaching the side walls to the bottom and joining individual side walls together by hinge device. Individual hinge elements, each containing a hinge hole, are alternatively provided on two joint parts to interlock, the number of the required hinge elements depending on the size of the container. All the hinge holes of the interlocked hinge elements join together to form a tunnel to let pass a link rod. The more the required hinge elements are, the more difficult it is to produce such hinge elements. In the case of a container made of plastic materials, there is additional difficulty in removing the mold after injection molding.

SUMMARY OF THE INVENTION

One object of this invention, therefore, is to provide the hinges designed to facilitate removing the mold after injection molding.

Another object of this invention is to reinforce the plastic structure with a small number of strip ribs and a large number of groove ribs, as we know groove ribs have higher section modulus than strip ribs according to mechanics of material.

Another object of this invention is to lessen the trouble of dismantling or assembling the hinge device by not joining the side walls together with hinge device but by providing a groove on each side border of one pair of opposed side walls to receive respective side border of another opposed side walls.

Another object of this invention is to make the container weather-proof by providing an eave piece on each space between individual hinge elements on the side walls to prevent the rain water from seeping inside the container.

Still another object of this invention is to provide the sealing nail to seal the container for ensuring some valuable containment after arriving at the destination is the original one.

BRIEF DESCRIPTION OF THE DRAWINGS

These and other objects and advantages of the present invention will be more apparent from the following detailed description of a preferred embodiment with reference to accompanying drawings, wherein.

DESCRIPTION OF THE PREFERRED EMBODIMENTS

Figure 1:
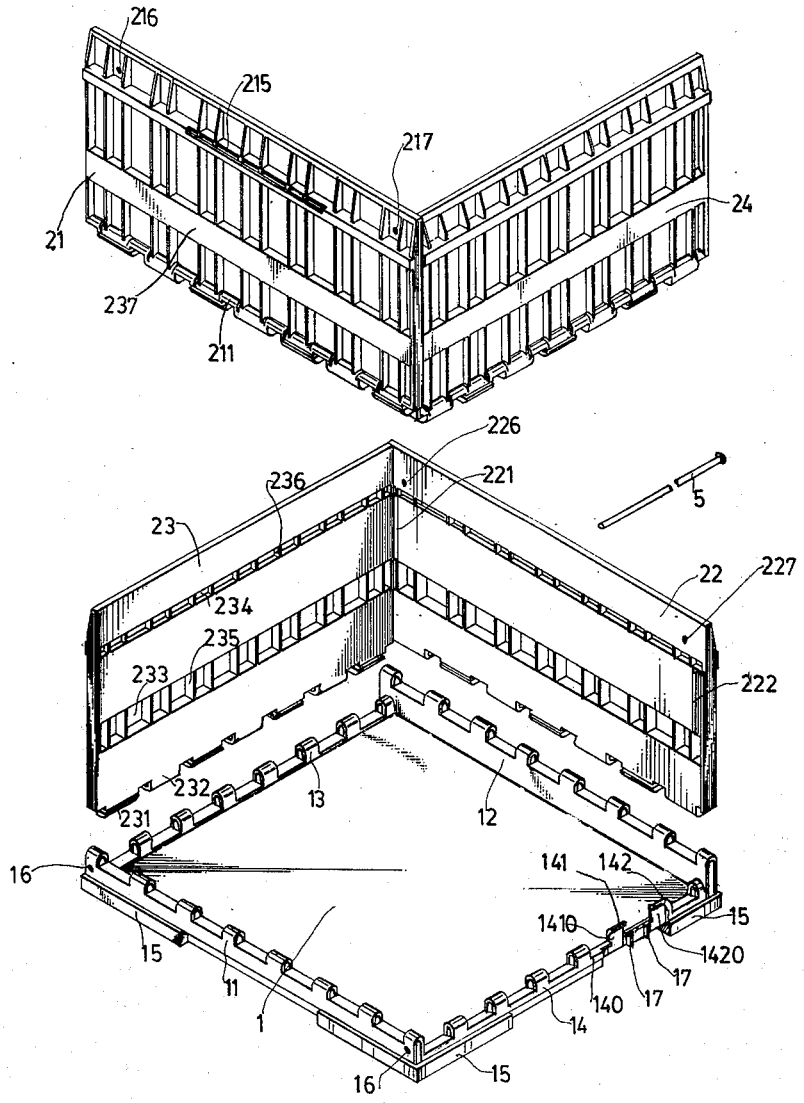
FIG. 1 is an exploded perspective view of the container in accordance with the present invention.

Referring to FIG. 1, individual hinge elements, each containing a hinge hole are alternatively provided on four border ramparts 140 of a bottom 1 and four bottom borders respectively of side walls 21, 22, 23, 24 to interlock. Each line of hinge holes of interlocked hinge elements join together to form a tunnel to let pass a link rod 5, thereby each side wall 21, 22, 23, 24 is attached to the bottom 1. Each link rod 5 after piercing through each line of hinge holes is riveted at the end.

The opposed hinge series 11, 12 respectively on a pair of opposed border ramparts of the bottom 1 are higher than the opposed hinge series 13, 14 respectively on another pair of opposed border ramparts of the bottom 1 by the thickness of a side wall so that when side walls 21, 22, 23, 24 are collapsed inwardly, side wall 21, 22 hinged to hinge series 11, 12 can be suitably collapsed on side walls 23, 24 hinged to hinge series 13, 14.

Correspondingly, side walls 21, 22 are higher than side walls 23, 24 by the thickness of a side wall so that side walls 21, 22, 23, 24 may reach the same height when hinged to and erecting on the bottom 1.

Each hinge hole 1410 of each hinge element 141 of hinge series 11, 12, 13, 14 has no bottom so that the mold of the hinge element 141 can be removed directly from the lower face of the border rampart 140 after injection molding.

Each hinge element 231, 232 on the bottom borders of side walls 21, 22, 23, 24 is hook-shaped. The hook mouth of the hinge element 231 is provided on the inner face of the side wall while the hook mouth of the adjacent hinge element 232 is provided on the outer face of the side wall. The hook mouth of each hinge element on the bottom borders of side walls 21, 22, 23, 24 is thus alternatively provided on the inner faces and the outer faces of side walls 21, 22, 23, 24 so that the mold of each hinge element 231, 232 can be removed easily after injection molding.

Figure 2:
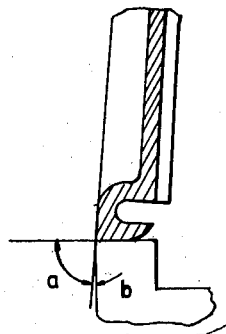
FIG. 2 is an exploded view showing the hinge element on the side wall.

As shown in FIG. 2, hinge series 11,12 are respectively inclined inwardly about 5° from the vertical line so that side walls 21, 22 respectively hinged to hinge series 11, 12 are also, when erecting, inclined inwardly about 5° from the vertical line.

Two ends respectively of hinge series 13, 14 are set between two ends respectively of hinge series 11, 12, so that side borders of side walls 23, 24 when erecting can be set between side borders of side wall 21, 22 when erecting.

Beside each side border on the inner faces of side walls 21, 22 is provided a protuberant 221, 222 which collaborates with each side border flange to form a groove for receiving respective side border of side walls 23, 24.

Erecting side walls 21, 22 on the inclined hinge series 11, 12, then erecting side walls 23, 24 by sliding side borders of side walls 23, 24 through protuberants 221, 222 to be set into grooves beside protuberants 221, 222, side walls 23, 24 shall push side walls 21, 22 to a vertical position. The elasticity of side walls 21, 22 shall generate a counter force permitting side walls 21, 22 to be closely engaged with side walls 23, 24.

Figure 3:
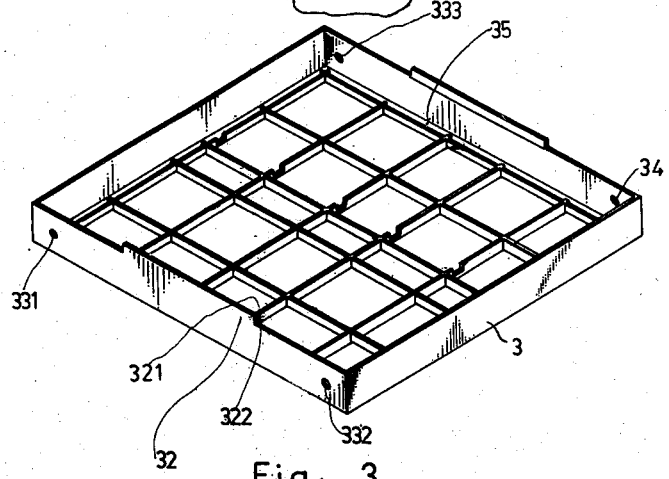
FIG. 3 is an end view of the lid of the container in accordance with the present invention.

To reinforce the structure, strip ribs are provided on the lower face of the bottom 1. On the outer faces of side walls 21, 22, 23, 24, groove ribs 233, 234 are provided to reinforce the structure in longitudinal direction and strip ribs 235, 236 are provided to reinforce the structure in vertical direction. One transverse groove rib 237 on the side wall 21 can be labelled to indicate the name and other concerning information of the containment. As shown in FIG. 3, strip ribs are provided on the inner face of the lid 3 to reinforce the structure.

To stably join the lid 3 with the erecting side walls, on the inner face of the lid 3, each border flange of the lid 3 collaborates with adjacent strip rib to form a groove 35 for receiving the top border of each side wall. A hook piece 32 is provided on each of a pair of opposed border flanges of the lid 3 intended to join with side walls 21, 22 for hooking onto a transverse strip rib 215 provided on each side wall 21, 22. A slight pressure applied on the hook piece 32 can make the oblique section 321 of hook piece 32 slide through strip rib 215 and make the hook curve 322 of hook piece 32 hook thereon.

Figure 4:
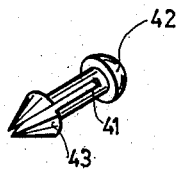
FIG. 4 is a perspective view of the sealing nail of the container in accordance with the present invention.

A hole 331, 332, 333, 334 is provided beside each end of each border flange containing hook piece 32. Correspondingly, at suitable spots of side walls 21, 22 are provided with holes 216, 217, 226, 227 to join respectively with holes 331, 332, 333, 334 when the lid 3 covers on the erecting side walls 21, 22, 23, 24. A sealing nail as shown in FIG. 4 is provided to pass through each of four groups of joined holes 216, 217, 226, 227, 331, 332, 333, 334.

The diameter of the nail body 41 is about the same as that of the holes 331, 332, 333, 334, 216, 217, 226, 227; the diameter of the bottom of the nail dart 43 is slightly bigger than the diameter of the nail body 41. A groove is provided along the longitudinal center line of the nail body 41 and the nail dart 43, so that the nail dart 43 and the nail body 41 can be nailed into each of four groups of joined holes 331, 332, 333, 334, 216, 217, 226, 227, impossible to loosen off. To open the lid 3 off the container, the nail cap 42 at the end of the nail body 41 must be cut off and the nail body 41 must be pushed inwardly off four groups of joined holes 331, 332, 333, 334, 216, 217, 226, 227.

Figure 5:
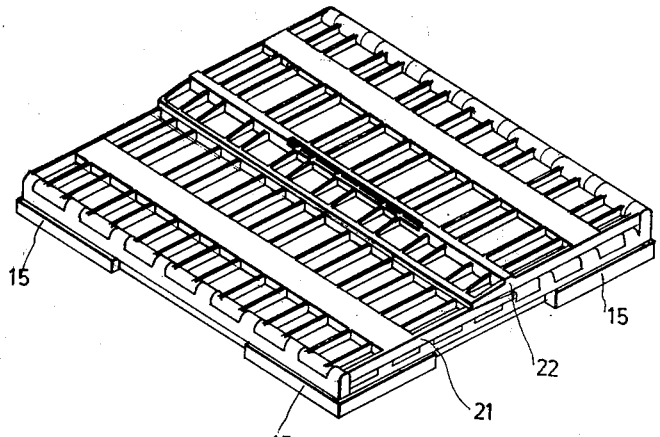
FIG. 5 is a perspective view of the container in collapsed condition.

After removing the lid 3, slightly pulling side walls 21, 22, outwardly shall loosen side borders of side walls 23, 24 off groves beside side borders of side walls 21, 22, thereby disengaging side walls 23, 24 from side walls 21, 22 and permitting side walls 23, 24 to collapse inwardly. Side walls 21, 22 collapse on the collapsed side walls 23, 24 as shown in FIG. 5. Covering the lid 3 on the collapsed side walls 21, 22, and applying slight pressure on the hook piece 32 shall make the hook piece 32 hook to the bottom border of the bottom 1 as shown in FIG. 6.

Figure 6:
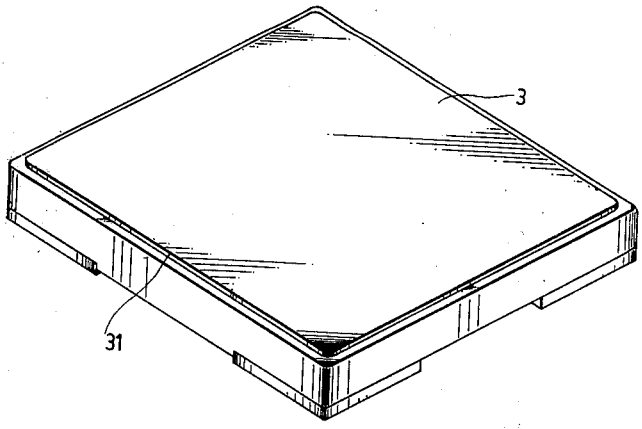
FIG. 6 is a perspective view of the collapsed container covered with the lid.

As shown in FIG. 6, on the outer face of the lid 3 is provided a projecting plug 31. On each corner of the lower face of the bottom 1 is provided a reinforced foot 15. A container of this invention can be closely piled on another one by engaging the reinforced feet of the upper container with the projecting plug of the lower container.

To make the container weatherproof, an eave piece 211 is provided on each space between individual hinge elements on side walls 21, 22, 23, 24 for preventing the rain water from seeping inside the container through the seams between the interlocked hinge elements.

As the plastic material used in this invention is relatively soft therefore the pressure applied to the container and the elasticity of the container are possible without deforming the structure.

As this invention may be embodied in several forms without departing from the spirit or essential characteristics thereof, the present embodiment is therefore for illustration only and not for restriction. The scope of the invention shall be defined by the appended claims.

What is claimed is:

1. A folding container molded from plastic materials comprising:

four side walls having an inner face, an outer face and bottom borders, a bottom having a border and a lower face, and a lid; and individual hing elements alternatively provided on said border of said bottom and on said bottom borders of said side walls to interlock, those of said hinge elements on said border of said bottom having no base portion so that a mold thereof can be removed from said lower face of said bottom.

2. A folding container according to claim 1, wherein each of said hinge elements on said bottom borders of said side walls is hook-shaped, having its hook mouth alternatively provided on said inner face and on said outer face of said side walls so that the mold of said hook-shaped hinge elements can be removed easily after injection molding.

3. A folding container according to claim 1, including strip ribs and groove ribs provided on said side walls, said bottom and said lid to hold the container structure rigid.

4. A folding container according to claim 1, wherein beside each said bottom border on said inner face of a pair of opposed said side walls is provided with a groove to receive each said bottom border of another pair of opposed said side walls; and wherein those of said hinge elements intended to interlock with those on said side walls contain grooves to receive said bottom borders of another pair of said side walls and are slightly inclined inwardly.

5. A folding container according to claim 4, wherein said hinge elements slightly inclined inwardly are inclined 5° inwardly from a vertical line.

6. A folding container according to claim 1 or 4, wherein said lid is provided with a plurality of border flanges, a hook piece is provided on each said border flange of said lid intended to join with said side walls hinged to said hinge elements, said hook piece being able to hook onto a transverse strip rib on each said side wall hinged to said hinge elements and able to hook onto said border of said bottom when said lid is covered onto said side walls in collapsed form.

7. A folding container according to claim 1, wherein said lid has an outer face and said bottom has a lower face having corners; a projecting plug is provided on said outer face of said lid; and a reinforced foot is provided on each said corner of said lower face of said bottom.

8. A folding container according to claim 6, wherein each end of said border flange contains a hook piece provided with a hole; correspondingly at suitable spots of said side walls intended to join with said border flanges a respective hole is provided; said lid is covered onto erecting said side walls; a sealing nail is provided having a body and a dart, each said hole on said border flanges meets its respective said hole on said side walls to let pass said sealing nail, the diameter of said body of said sealing nail being about the same as that of said holes and the diameter of bottom of said dart of said sealing nail being slightly larger than the diameter of said holes; a groove is provided along a longitudinal center line of said dart of said nail; and a nail cap is provided at an end of said nail body, said nail cap being unable to be nailed down through said holes.

* * * * *